United States Patent [19]

Ferris et al.

[11] Patent Number: 4,570,938

[45] Date of Patent: Feb. 18, 1986

[54] BOARD GAME HAVING PIECES WITH PIVOTAL ARM

[75] Inventors: Michael J. Ferris; Paul H. Wise, both of Chicago; Jeffrey D. Breslow, Highland Park, all of Ill.

[73] Assignee: Marvin Glass & Associates, Chicago, Ill.

[21] Appl. No.: 513,778

[22] Filed: Jul. 15, 1983

[51] Int. Cl.[4] ..... A63F 3/00

[52] U.S. Cl. ..... 273/243; 273/289

[58] Field of Search ..... 273/289, 288, 255, 244, 273/262, 129 W, 85 C, 85 E; 24/4

[56] References Cited

U.S. PATENT DOCUMENTS

| | | | |
|---|---|---|---|
| 2,052,035 | 8/1936 | Potter | 273/94 |
| 2,933,316 | 4/1960 | Mancini | 273/244 X |
| 3,860,241 | 1/1975 | Leftin | 273/255 |
| 3,888,488 | 6/1975 | Sims | 273/289 X |
| 3,989,254 | 11/1976 | Cooper | 273/288 X |
| 4,157,183 | 6/1979 | Meyer et al. | 273/243 |

FOREIGN PATENT DOCUMENTS

| | | | |
|---|---|---|---|
| 1150745 | 1/1958 | France | 273/129 W |
| 1527493 | 10/1978 | United Kingdom | 273/262 |
| 2028148 | 3/1980 | United Kingdom | 273/241 |

*Primary Examiner*—Richard C. Pinkham
*Assistant Examiner*—Scott L. Brown
*Attorney, Agent, or Firm*—John S. Pacocha

[57] ABSTRACT

A board game in which the board has a plurality of congruent playing spaces with each space adjacent to at least one other space. A primary playing piece, which has a base and an upright body portion connected to the base, is provided with arms pivotally mounted on the body portion and spanned by a transverse bar to provide for a forward pivotally thrusting movement of the hand ends of the arms. Secondary playing pieces on adjacent spaces that are facing the primary playing piece may be zapped or knocked over by the forward pivotal thrust of the arms. The pieces are provided with a base and an upright body portion that is higher than either dimension of the base to facilitate knocking over the piece when it is zapped. Wall indicia along lines defined by adjacent spaces prevent movement of the pieces across the wall but permit zapping of a secondary piece by a primary piece across the wall.

7 Claims, 3 Drawing Figures

BOARD GAME HAVING PIECES WITH PIVOTAL ARM

BACKGROUND OF THE INVENTION

1. Field of the Invention

This invention relates generally to board games and more particularly to board games that embody a theme suggested by other media or events.

2. Background Art

Board games, particularly those based on various themes suggested by real life events or occurrences, or by other games, have long been popular. For example, prior art patents assigned to the assignee of the present invention disclose board games embodying the themes of: a beauty contest, U.S. Pat. No. 3,861,686; investment, U.S. Pat. No. 3,865,379; invention, U.S. Pat. No. 3,885,792; golf, U.S. Pat. No. 3,989,249; magic acts, U.S. Pat. No. 3,989,251; fast food franchises, U.S. Pat. No. 3,994,499; and the legendary creature "BIG FOOT" U.S. Pat. No. 4,128,246. Recently, video games, both the types playable in arcades and by means of adapters on home television sets, have become popular pastimes. Such video games have also provided themes for board games. There are currently board games based on the Bally/Midway "PAC-MAN", Nintendo "DONKEY KONG" and Sega "FROGGER" video games which are disclosed respectively in copending Applications Ser. Nos. 339,850, filed Jan. 18, 1982; 424,354, filed Sept. 27, 1982; and 426,368, filed Sept. 29, 1982, all of which are assigned to the assignee of the present invention. There remains, however, a need for additional portable board games that provide entertaining, challenging and competitive play of a game employing a theme suggested by popular video games. Moreover, since a number of the video games require the player to shoot various robots, aliens, and other creatures, there is a need to stimulate such shooting action by the player in a board game in order to embody the video game theme in a board game.

SUMMARY OF THE INVENTION

The present invention is concerned with providing a portable board game for competitive play that employs the theme of the Stern Electronics, Inc. "BERZERK" video game and provides a mechanical shooting action for zapping enemy robots. These and other objects and advantages of the invention are achieved by a board game having a rectangular playing field divided into files and transverse rows of congruent square playing spaces. A primary humanoid playing piece which has pivotally thrustable arms must be moved from an entry square in the player's home row to an exit square in opponent's home row. Robot pieces which are moveable from one adjacent square to another may be shot and knocked over by the humanoid playing piece when the humanoid piece is on a square adjacent to the robot and facing the robot. Wall indicia are provided on the board surface along lines defined by adjacent squares and such wall indicia prevent movement of the humanoid and robot pieces across the wall but do permit the humanoid to shoot a robot on the adjacent square on the other side of the wall. Each of the playing pieces is provided with a base that fits within the square playing space and an upright body portion that is higher than either the length or width of the base to facilitate shooting or knocking over the pieces.

BRIEF DESCRIPTION OF THE DRAWINGS

For a better understanding of the present invention, reference may be had to the accompanying drawing in which.

DETAILED DESCRIPTION OF THE PREFERRED EMBODIMENT

Figure 1:
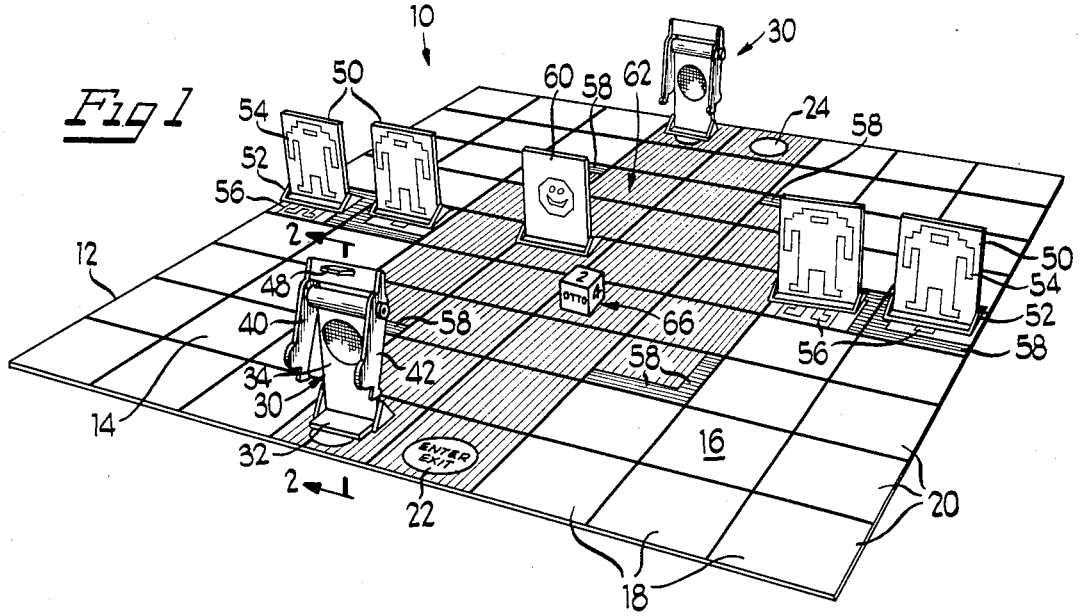
FIG. 1 is a perspective view of an embodiment of the present invention.
Figure 2:
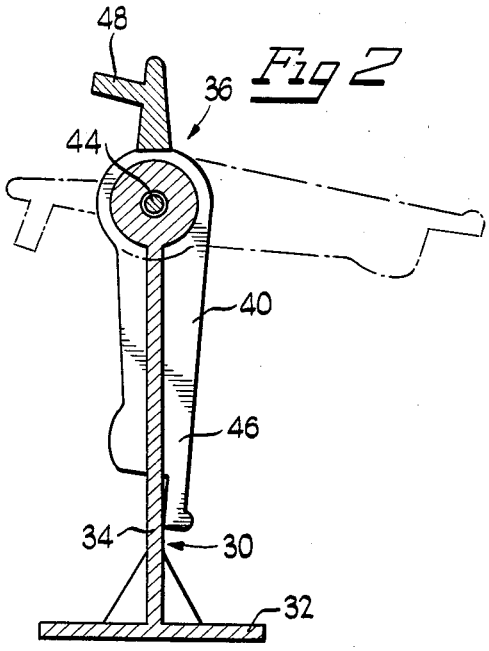
FIG. 2 is an enlarged sectional view of the primary playing piece taken substantially along the line 2—2 in FIG. 1.

Referring now to the drawings in which like parts are designated by like reference characters throughout the several views, there is shown in FIG. 1 a board game 10 which includes a game board game 12. A rectangular playing field 14 is defined on the game board 12 and comprises congruent square playing spaces 16 forming files 18 and transverse rows 20. An entry position 22 is indicated on a preselected square in the peripheral row nearest the player and that square also serves as the exit position for the opposing player. Similarly an exit/entry position 24 is indicated in a square in the peripheral row of the opposite end of the board 12.

Each of the two players is provided with a primary humanoid playing piece 30 having a base 32 which sits within each of the squares 16 and an upstanding body portion 34 attached at one end to the base 32. Between the ends, preferably nearer the upper free end of the upright body portion, a thrusting arm assembly 36 is mounted for pivotal movement in a plane transverse to the game board 12. The arm assembly 36 includes arms 40 and 42 each of which is mounted for pivotal movement about shaft 44 such that the arm assembly forms a first class lever with the center of the shaft 44 as the fulcrum. On each arm, the hand end 46 is conveniently formed in the shape of a hand gripping a pistol while the other, shoulder, end is connected to an actuating bar 48. The ends of the shaft 44 project out beyond the arms 40 and 42 and are journaled for rotational movement adjacent the upper end of the body portion 34 of the humanoid piece 30. Thus, the arms are mounted for movement about the axis of the shaft 44 relative to the base 32. Transverse rearwardly projecting tab or bar 48 extends between arms 40 and 42 and limits the movement of the arms to a pivotal movement of approximately 270 degrees. The weight of the arms maintains them in a usually neutral, or at rest, position wherein they are substantially aligned with the upright body portion 34.

Because the tab or bar 48 projects rearwardly, a downward force exerted on the projecting end of the bar will cause the arms and particularly the hand ends 46 of each of the arms to make a thrusting movement from the neutral to a shooting position wherein the arms extend substantially transverse to the upright body portion 34 and out beyond the base 32. The length of the arm from the shaft 44 to the extremity of hand end 46 is preferably equal to or even somewhat greater than, the length of one side of the playing square 16. Therefore, whenever the humanoid is positioned within a playing square 16 and a downward force is exerted on the bar 48, the arms 40 and 42 should thrust upwardly and outwardly a sufficient amount to knock over a piece on an adjacent square having a base and upright body position of somewhat similar dimensions to that of the humanoid piece 30.

A set of playing pieces 50 representing robots are moveable by either player. Each of the robots has a base 52 and upright body portion 54. Similar to the humanoid pieces 30 the height of the body portion is greater, preferably about three times greater, than the width and than the length of the base 52. As illustrated in FIG. 1 there are four of the robots 50 and one robot is initially placed on each of four squares 56 in the center row of the two outermost files which have appropriate indicia designating the squares 56 for the initial robot placement. In the embodiment shown and described, the primary humanoid playing pieces 30 and the robots 50 may be moved from one adjacent square to another, either up and down a file 18 or across a row 20, one square at a time. If a player has more than one move in a turn, a combination of moves from square to square in a row or a file may be used, but the robot may not be moved diagonally from square to square. Also provided on the playing field 14 are a plurality of wall indicia 58 which lie along preselected lines of the lines defined by adjacent spaces or squares 16. Neither the humanoid pieces 30 nor the robots 50 may usually move across a wall indicia 58. However, the humanoid pieces 30 can, by thrusting of the arms, shoot across a wall indicia 58 to knock over a robot 50.

An enemy piece 60, also moveable by either player, is identified as "Evil Otto" of the "BERZERK" video game. Piece 60 may be moved any of a number of squares along a file 18 or row 20 in which the square occupied by the piece 60 lies at the beginning of a move similar to the movement of the rook in chess. Movement of piece 60 is also limited to the central zone 62 comprising the entirety of the two central files and the five central rows of the next file over from each of the central files. Another limitation on the movement of the piece 60 is that it cannot move onto or through a square occupied by one of the robot pieces 50. Should a player's humanoid playing piece 30 be in the zone 62 and in line with piece 60, without any intervening robot piece 50, and the opposing player is permitted by chance means to move the piece 60, it will result in the player having to return the primary playing piece 30 to the player's respective entry position 22 or 24.

Figure 3:
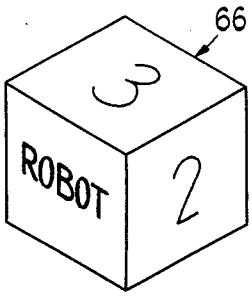
FIG. 3 is an enlarged perspective view showing the three sides of the die not shown in FIG. 1.

The chance selection device 66 is a cubic die having six sides with indicia on each of the sides. As shown in FIGS. 1 and 3 the indicia in this embodiment are: OTTO; 2; 4; ROBOT; 3; and 2. When a player rolls the die 66 and obtains any of the numerals 2, 3, or 4 the player may move the number indicated on the die with the humanoid playing piece 30 or, one or more robots 50, but not the humanoid and a robot within a single turn. While the player is free to move from file to file as long as the pieces 30 or 50 do not move onto a square occupied by the "Evil Otto" piece 60, in order to move from one row 20 to another row the player must first zap a robot 50 on the adjacent row and then jump over the zapped robot to the next adjacent row within the file. When the humanoid zaps a robot it counts as one of the moves in that turn. If the player is moving the humanoid piece 30 and lands on a square adjacent one occupied by a robot 50, the player may zap the robot by having the robot 50 and the humanoid piece 30 face each other and depressing the tab or bar 48 with the finger of one hand while holding down the base 32 of humanoid piece 30 with a finger of the other hand.

When "ROBOT" turns up in the die then the player may move any one robot 50 anywhere on the board not already occupied by another playing piece. Should the "OTTO" indicia turn up, the player may move the piece 60 to attack the opponent's humanoid 30. The attack is, as previously described, limited to the zone 62 and is conducted by moving "Evil Otto" in a straight line along either the file 18 or the row 20 in which the square lies that is occupied by the "Evil Otto" playing piece 60 at the beginning of that turn. Since the "Evil Otto" piece 60 has a structure similar to that of the robots 50, the playing piece 30 is capable of knocking over the piece 60 by means of the pivotal forward thrusting of the arms 40 and 42. However, by rule the humanoid 30 is prevented from zapping "Evil Otto" and the only defense is to have a robot 50 interposed between "Evil Otto" and the humanoid piece.

At the start of the game, the robot pieces 50 are placed on the squares 56 as previously indicated and the players each roll the die to determine the order of play. It has been found to result in equitable allocation to award one of the players, for example the one getting the highest number on the roll of the die, the right to start play while the opponent has the right to place "Evil Otto" anywhere within the zone 62. Thereafter, play is commenced with the first player again rolling the die and proceeding to move either the player's own humanoid 30, one or more of the robots 50, or "Evil Otto" 60 in accordance with the indicia resulting from the roll of the die 66.

While a particular embodiment of the present invention has been shown and described, changes and modifications will occur to those skilled in the art. For example, rather than each player having a humanoid piece 30 and "Evil Otto" 60 being moveable by either player, one of the humanoid pieces 30 could be eliminated and the opposing players would alternate using the humanoid 30 or "Evil Otto" 60 in alternating rounds to make up a complete game. It is intended in the appended claims to cover all such changes and modifications as fall within the true spirit and scope of the present invention.

What is claimed as new and desired to be secured by Letters Patent is:

1. A board game comprising:

a game board having a plurality of congruent playing spaces with each space being adjacent to at least one other space;

a primary playing piece and at least one secondary playing piece;

each playing piece having a base and an upright body portion connected to the base;

the primary and secondary pieces being moveable from one playing piece space to an adjacent playing space with the base of each fitting within and resting upon the playing space;

the primary playing piece and each secondary playing piece moveable into a respective position on an adjacent space with the primary playing piece and the secondary playing piece oriented to face each other;

each secondary playing piece base having a dimension parallel to the facing orientation;

the upright body portion of each secondary playing piece having a height approximately three times as great as the dimension of the base parallel to the facing orientation;

shooting means mounted on the primary playing piece for movement relative to the base from a neutral position to a shooting position for hitting and knocking over a secondary playing piece that is on an adjacent space and facing the primary playing piece;

the primary playing piece including player operable tab means for actuating movement of the shooting means relative to the base;

the shooting means being pivotally mounted to the upright body portion of the primary playing piece;

the shooting means including an arm generally aligned with the upright body portion in the neutral position and substantially transverse to the body portion in the shooting position; and the arm has a free end that is thrust out beyond the space when in the shooting position.

2. The board game of claim 1 in which the height of the upright body portion of the playing pieces is greater than the width and greater than the length of the base.

3. The board game of claim 2 in which the upright body portion is approximately three times as high as the width of the base and approximately three times as high as the length of the base.

4. The board game of claim 1 in which a pin extends through the arm intermediate the tab means and the free end of the arm and one end of the pin is inserted into the body portion between the base and the upper end of the portion.

5. The board game of claim 1 in which a pair of arms are provided and the player operable tab means includes a tab extending between the pair of arms and projecting transverse to the length of the arm.

6. The board game of claim 1 including wall indicia on the game board along a line defined by adjacent playing spaces.

7. The board game of claim 1 in which:

the game board has a rectangular playing field with the playing spaces being squares forming a series of files and transverse rows; and chance means are provided to determine the type of move available in any one turn.

* * * * *